US012643146B2

(12) United States Patent
Zhan et al.

(10) Patent No.: US 12,643,146 B2
(45) Date of Patent: Jun. 2, 2026

(54) PRODUCING POLYCRYSTALLINE DIAMOND COMPACT (PDC) DRILL BITS WITH CATALYST-FREE AND SUBSTRATE-FREE PDC CUTTERS

(71) Applicants: Saudi Arabian Oil Company, Dhahran (SA); Chengdu Dongwei Technology Co., LTD, Chengdu (CN)

(72) Inventors: Guodong Zhan, Dhahran (SA); Jianhui Xu, Dhahran (SA); Timothy E. Moellendick, Dhahran (SA); Duanwei He, Chengdu (CN)

(73) Assignees: SAUDI ARABIAN OIL COMPANY, Dhahran (SA); CHENGDU DONGWEI TECHNOLOGY CO., LTD, Chengdu (CN)

( * ) Notice: Subject to any disclaimer, the term of this patent is extended or adjusted under 35 U.S.C. 154(b) by 193 days.

(21) Appl. No.: 17/567,531

(22) Filed: Jan. 3, 2022

(65) Prior Publication Data

US 2023/0211414 A1 Jul. 6, 2023

(51) Int. Cl.

| | |
|---|---|
| ***B22F 7/00*** | (2006.01) |
| ***B22F 3/24*** | (2006.01) |
| ***B22F 7/02*** | (2006.01) |

(52) U.S. Cl.

CPC ..... *B22F 7/008* (2013.01); *B22F 3/24* (2013.01); *B22F 7/02* (2013.01); *B22F 2003/247* (2013.01); *B22F 2302/406* (2013.01)

(58) Field of Classification Search

CPC .... B22F 7/008; B22F 3/24; B22F 7/02; B22F 2003/247; B22F 2302/406; B22F 10/00; B22F 10/14; B22F 7/06

See application file for complete search history.

(56) References Cited

U.S. PATENT DOCUMENTS

| | | | |
|---|---|---|---|
| 3,632,369 | A | 1/1972 | Hahn et al. |
| 4,017,480 | A | 4/1977 | Baum |

(Continued)

FOREIGN PATENT DOCUMENTS

| | | |
|---|---|---|
| AU | 2005286168 | 3/2006 |
| CN | 104612583 | 5/2015 |

(Continued)

OTHER PUBLICATIONS

U.S. Appl. No. 17/170,006, Zhan et al., filed Feb. 8, 2021.

(Continued)

*Primary Examiner* — Ricardo D Morales

(57) ABSTRACT

Methods for forming a polycrystalline diamond compact (PDC) drill bit from catalyst-free synthesized polycrystalline diamonds are described. The polycrystalline diamonds are deposited within a mold. In some cases, a matrix body material is deposited within the mold, and an infiltration process is performed to bond the polycrystalline diamonds to the matrix body material to form the PDC drill bit. In some cases, a drill bit body is formed within the mold, and forming the drill bit body within the mold includes depositing a layer of matrix body material particles within the mold, depositing an adhesive ink within the mold, and curing the adhesive ink. In some cases, a sintering process is performed after forming the drill bit body to remove at least a portion of the adhesive ink and increase a density of the drill bit body to form the PDC drill bit.

9 Claims, 7 Drawing Sheets

(56) References Cited

U.S. PATENT DOCUMENTS 4,129,437 A 12/1978 Taguchi et al.
4,181,752 A * 1/1980 Martens ..... C09J 7/385 526/318.4
4,255,165 A 3/1981 Dennis et al.
4,288,248 A 9/1981 Bovenkerk et al.
4,334,928 A 6/1982 Hara
4,343,651 A 8/1982 Yazu et al.
4,394,170 A 7/1983 Sawaoka et al.
4,525,178 A 6/1985 Hall
4,664,705 A * 5/1987 Horton ..... B01J 3/062 419/48
4,859,531 A 8/1989 Tsuji et al.
4,943,488 A 7/1990 Sung et al.
4,945,073 A 7/1990 Dubensky et al.
5,000,273 A 3/1991 Horton et al.
5,030,276 A 7/1991 Sung et al.
5,037,704 A 8/1991 Nakai et al.
5,096,465 A 3/1992 Chen et al.
5,199,832 A * 4/1993 Meskin ..... E21B 10/5676 175/373
5,326,380 A 7/1994 Yao et al.
5,337,844 A 8/1994 Tibbitts
5,370,195 A 12/1994 Keshavan et al.
5,387,776 A 2/1995 Preiser
5,523,158 A 6/1996 Kapoor et al.
5,603,070 A 2/1997 Cerutti et al.
5,833,021 A 11/1998 Mensa-Wilmot et al.
5,848,348 A 12/1998 Dennis
5,889,219 A 3/1999 Moriguchi et al.
6,008,153 A 12/1999 Kukino et al.
6,073,518 A 6/2000 Chow et al.
6,096,436 A 8/2000 Inspektor
6,209,420 B1 4/2001 Butcher et al.
6,453,899 B1 9/2002 Tselesin
6,469,278 B1 10/2002 Boyce
6,623,850 B2 9/2003 Kukino et al.
7,322,776 B2 1/2008 Webb et al.
7,441,610 B2 10/2008 Belnap et al.
7,645,513 B2 1/2010 Bello et al.
7,647,992 B2 1/2010 Fang et al.
8,071,173 B1 12/2011 Sani
8,130,903 B2 3/2012 Corbett et al.
8,512,865 B2 8/2013 DiGiovanni
8,734,552 B1 5/2014 Vail et al.
8,931,582 B2 1/2015 Cooley et al.
8,960,337 B2 2/2015 Hall et al.
9,097,074 B2 8/2015 Shen et al.
9,254,554 B1 2/2016 Bertagnolli
9,435,159 B2 9/2016 Scott
9,482,056 B2 11/2016 Eyre et al.
9,683,410 B2 6/2017 Zhang et al.
10,017,998 B2 7/2018 Bilen et al.
10,118,223 B2 11/2018 Eason
10,179,390 B2 1/2019 Mukhopadhyay et al.
10,612,311 B2 4/2020 Duerholt
10,682,238 B2 6/2020 Petersheim et al.
10,704,334 B2 7/2020 Jiang
10,711,331 B2 7/2020 Chang et al.
10,946,500 B2 3/2021 Chapman et al.
2003/0052098 A1 3/2003 Kim et al.
2008/0223623 A1* 9/2008 Keshavan ..... C04B 35/645 156/60
2008/0312892 A1 12/2008 Heggemann
2010/0276209 A1 11/2010 Yong et al.
2011/0031026 A1 2/2011 Oxford et al.
2011/0083908 A1 4/2011 Shen et al.
2011/0271603 A1 11/2011 Voronin et al.
2012/0097457 A1 4/2012 Setlur et al.
2012/0125696 A1 5/2012 Belnap et al.
2013/0056284 A1 3/2013 Atkins et al.
2013/0067824 A1 3/2013 King et al.
2013/0277121 A1 10/2013 Stevens et al.
2013/0320598 A1* 12/2013 Atkins ..... B21K 5/04 264/219
2014/0110180 A1* 4/2014 Yu ..... E21B 10/5735 175/428
2014/0123562 A1 5/2014 Voronin
2014/0174633 A1 6/2014 Andersin et al.
2014/0283457 A1 9/2014 Cariveau et al.
2014/0318392 A1 10/2014 Sajgalik et al.
2015/0075714 A1 3/2015 Sun et al.
2015/0284833 A1 10/2015 Hsiao et al.
2015/0292270 A1 10/2015 Zhang et al.
2018/0029942 A1 2/2018 Ishida
2018/0058148 A1 3/2018 Zhang et al.
2018/0126516 A1 5/2018 Kanyanta et al.
2018/0202234 A1 7/2018 Saini et al.
2018/0208511 A1 7/2018 Liang et al.
2018/0215671 A1 8/2018 Sani et al.
2018/0265416 A1 9/2018 Ishida et al.
2019/0078390 A1 3/2019 Belnap et al.
2020/0001367 A1 1/2020 Duffy et al.
2021/0032934 A1 2/2021 Zhan
2021/0034029 A1 2/2021 Zhan et al.
2021/0238102 A1 8/2021 Terasaki
2021/0277721 A1 9/2021 Portwood et al.
2021/0370396 A1 12/2021 Zhan et al.
2021/0371345 A1 12/2021 Zhan et al.
2022/0250989 A1 8/2022 Zhan et al.
2023/0201921 A1 6/2023 Zhan et al.
2023/0212914 A1 7/2023 Zhan et al.

FOREIGN PATENT DOCUMENTS

CN 105127430 12/2015
CN 103953279 2/2016
CN 106119763 11/2016
CN 103803985 8/2017
CN 108950561 12/2018
CN 109046179 12/2018
CN 109437920 3/2019
CN 110369714 10/2019
EP 0437855 7/1991
EP 3333141 6/2018
GB 1572460 7/1980
GB 1574615 9/1980
JP S 62274034 11/1987
JP 2009067609 4/2009
JP 4275896 6/2009
JP 5013156 8/2012
WO WO 81/003295 11/1981
WO WO 99/036658 7/1999
WO WO 2006032984 3/2006
WO WO 2010111578 9/2010
WO WO 2014088569 6/2014
WO WO 2017011415 1/2017
WO WO 2018167022 9/2018

OTHER PUBLICATIONS

U.S. Appl. No. 17/336,637, Zhan et al., filed Jun. 2, 2021.
U.S. Appl. No. 17/740,741, Zhan et al., filed May 10, 2022.
U.S. Appl. No. 63/031,077, Zhan et al., filed May 28, 2020.
U.S. Appl. No. 63/033,669, Zhan et al., filed Jun. 2, 2020.
Commer et al., "New advances in three-dimensional controlled-source electromagnetic inversion," Geophys. J. Int., 2008, 172:513-535, 23 pages.
Durrand et al., "Thick PDC, Shaped Cutters for Geothermal Drilling: A Fixed Cutter Solution for a Roller Cone Drilling Environment," 44th U.S. Rock Mechanics Symposium and 5th U.S.-Canada Rock Mechanics Symposium, Jun. 2010, 11 pages.
Ju, "Rock Breaking Mechanism Analysis and Structure Design of the Conical PDC Cutter Based on Finite Element Method," Engineering Letters, Mar. 2019, 27(1):75-80, 6 pages.
Liu et al., "Hardness of Polycrystalline Wurtsite Boron Nitride (wBN) Compacts," Scientific Reports, Jul. 2019, 9(1), 6 pages.
Liu et al., "Superstrong micro-grained polycrystalline diamond compact through work hardening under high pressure," Appl. Phys. Lett., Feb. 2018, 112, 6 pages.
Metco, "An Introduction to Thermal Spray," 2013, Issue 4, 24 pages.

(56) References Cited

OTHER PUBLICATIONS

Thefreedictionary.com [online], "Paddle", Jan. 2004, retrieved on Apr. 12, 2021, retrieved from URL <https://www.thefreedictionary.com/paddle>, 8 pages.
Utkin et al., "Shock Compressibility and Spallation Strength of Cubic Modification of Polycrystalline Boron Nitride," High Temperature, 2009, 47(5):628-634, 7 pages.
Xiong et al., "Comparative analysis cutting characteristics of stinger PDC cutter and conventional PDC cutter," Journal of Petroleum Science and Engineering, Jun. 2020, 13 pages.
U.S. Appl. No. 17/549,290, Xu et al., filed Dec. 13, 2021.
Aghaei, "Atomic Layer Deposition: An Overview Al 2 O 3 ALD on Carbon Nanotubes and Graphene Surfaces," Chem. Rev., 2010, 110:111-131, 22 pages.
Fabreguette et al., "Ultrahigh x-ray reflectivity from W/Al2O3 multilayers fabricated using atomic layer deposition," Appl. Phys. Lett., 2006, 88, 013116, 3 pages.
Meta-Braze VBC Group, "Meta-Braze Cu93Ti: Copper based brazing alloy for ceramics," 2018, 1 page.
meta-braze.com [online], "Copper Brazing Alloys for Tungsten Carbide," available on or before Sep. 30, 2020 via Internet Archive Wayback Machine URL <https://web.archive.org/web/20200930185357/https://www.meta-braze.com/products/base-metal-brazing-alloys/copper-brazing-alloys-for-tungsten-carbide>, retrieved on Mar. 15, 2022, retrieved from URL <https://www.meta-braze.com/products/base-metal-brazing-alloys/copper-brazing-alloys-for-tungsten-carbide>, 2 pages.
meta-braze.com [online], "Nickel based Brazing Alloys," available on or before Aug. 12, 2020 via Wayback Machine Archive URL <https://web.archive.org/web/20200812204140/https://www.meta-braze.com/products/base-metal-brazing-alloys/nickel-based-brazing-alloys>, retrieved on Mar. 15, 2022, retrieved from URL <https://www.meta-braze.com/products/base-metal-brazing-alloys/nickel-based-brazing-alloys>, 3 pages.
Li et al., "Ultrastrong catalyst-free polycrystalline diamond," Nature Research, Scientific reports, Dec. 2020, 10:22020, 10 pages.
Zhan et al., "New Ultra-Strong and Catalyst-Free PDC Cutting Element Technology," IPTC-19764- MS, International Petroleum Technology Conference, Jan. 13-15, 2020, 12 pages.
GCC Examination Report in GCC Appln. No. GC 2020-40173, dated Sep. 26, 2021, 5 pages.
GCC Examination Report in GCC Appln. No. GC 2020-40176, dated Sep. 7, 2021, 3 pages.
PCT International Search Report and Written Opinion in International Appln. No. PCT/US2020/043411, dated Oct. 23, 2020, 15 pages.
PCT International Search Report and Written Opinion in International Appln. No. PCT/US2020/043872, dated Oct. 20, 2020, 25 pages.
PCT International Search Report and Written Opinion in International Appln. No. PCT/US2021/034192, dated Aug. 31, 2021, 14 pages.
PCT International Search Report and Written Opinion in International Appln. No. PCT/US2021/035424, dated Sep. 20, 2021, 15 pages.
PCT International Search Report and Written Opinion in International Appln. No. PCT/US2023/010037, dated Apr. 17, 2023, 20 pages.
PCT International Search Report and Written Opinion in International Appln. No. PCT/US2023/019553, dated Jul. 18, 2023.
CN Office Action in Chinese Appln. No. 202180038314.9, dated Jul. 18, 2023, 24 pages, with English Translation.

* cited by examiner

PRODUCING POLYCRYSTALLINE DIAMOND COMPACT (PDC) DRILL BITS WITH CATALYST-FREE AND SUBSTRATE-FREE PDC CUTTERS

TECHNICAL FIELD

This disclosure relates to production of polycrystalline diamond compact (PDC) drill bits and, particularly, PDC drill bits for the oil and gas industry.

BACKGROUND

Drilling hard, abrasive, and interbedded formations poses a difficult challenge for conventional PDC drill bits where the PDC cutter is formed using conventional high pressure and high temperature (HPHT) technology. Historically, a conventional polycrystalline diamond material, generally forming a cutting layer, also called diamond table, dulls quickly due to abrasive wear, impact damage, and thermal fatigue. Thus, hardness, fracture toughness, and thermal stability of polycrystalline diamond materials represent three limiting factors for an effective PDC drill bit.

SUMMARY

Certain aspects of the subject matter described can be implemented as a method. Catalyst-free synthesized polycrystalline diamonds are provided. Each of the polycrystalline diamonds have a cross-sectional dimension of at least 4 millimeters. The polycrystalline diamonds are deposited within a mold. After depositing the polycrystalline diamonds within the mold, a matrix body material is deposited within the mold. An infiltration process is performed to bond the polycrystalline diamonds to the matrix body material and form a polycrystalline diamond compact (PDC) drill bit. The infiltration process includes heating the polycrystalline diamonds and the matrix body material deposited within the mold to an infiltration temperature greater than about 700 degrees Celsius (° C.) and less than about 1400° C.

This, and other aspects, can include one or more of the following features. In some implementations, providing the polycrystalline diamonds includes synthesizing each of the polycrystalline diamonds from diamond powder with a particle size within a range of from about 0.1 micrometers (μm) to about 50 μm. In some implementations, providing the polycrystalline diamonds includes shaping each of the synthesized polycrystalline diamonds by laser cutting or mechanical grinding. In some implementations, for each of the polycrystalline diamonds, the cross-sectional dimension of at least 4 millimeters is a first cross-sectional dimension, and each of the polycrystalline diamonds has a second cross-sectional dimension that is greater than the first cross-sectional dimension. In some implementations, the infiltration temperature is less than about 800° C. In some implementations, the infiltration temperature is about 800° C. In some implementations, the infiltration process includes heating the polycrystalline diamonds and the matrix body material deposited within the mold at a heating rate in a range of from about 1° C. per minute (° C./min) to about 40° C./min until the polycrystalline diamonds and the matrix body material deposited within the mold reach the infiltration temperature. In some implementations, the infiltration process includes maintaining the polycrystalline diamonds and the matrix body material deposited within the mold at the infiltration temperature for an infiltration time duration in a range of from about 10 minutes to about 180 minutes. In some implementations, the infiltration process includes cooling the polycrystalline diamonds and the matrix body material deposited within the mold at a cooling rate in a range of from about −1° C./min to about −40° C./min after maintaining the polycrystalline diamonds and the matrix body material deposited within the mold at the infiltration temperature for the infiltration time duration. In some implementations, the infiltration process includes removing the formed PDC drill bit from the mold.

Certain aspects of the subject matter described can be implemented as a method. Catalyst-free synthesized polycrystalline diamonds are provided. Each of the polycrystalline diamonds have a cross-sectional dimension of at least 4 millimeters. The polycrystalline diamonds are deposited within a mold. After depositing the polycrystalline diamonds within the mold, a drill bit body is formed within the mold. Forming the drill bit body within the mold includes (a) depositing a layer of matrix body material particles within the mold, (b) depositing an adhesive ink within the mold, (c) curing the adhesive ink, and (d) repeating (a), (b), and (c) in order until the drill bit body is formed. After forming the drill bit body, a sintering process is performed to remove at least a portion of the adhesive ink and increase a density of the drill bit body to form a PDC drill bit. The sintering process includes heating the polycrystalline diamonds and the drill bit body to a sintering temperature greater than about 600° C. and less than about 1400° C.

This, and other aspects, can include one or more of the following features. In some implementations, providing the polycrystalline diamonds includes synthesizing each of the polycrystalline diamonds from diamond powder with a particle size within a range of from about 0.1 micrometers (μm) to about 50 μm. In some implementations, providing the polycrystalline diamonds includes shaping each of the synthesized polycrystalline diamonds by laser cutting or mechanical grinding. In some implementations, for each of the polycrystalline diamonds, the cross-sectional dimension of at least 4 millimeters is a first cross-sectional dimension, and each of the polycrystalline diamonds has a second cross-sectional dimension that is greater than the first cross-sectional dimension. In some implementations, the sintering temperature is less than about 1000° C. In some implementations, the sintering temperature is about 750° C. In some implementations, the sintering process includes heating the polycrystalline diamonds and the drill bit body at a heating rate in a range of from about 1° C./min to about 40° C./min until the polycrystalline diamonds and the drill bit body reach the sintering temperature. In some implementations, the sintering process includes maintaining the polycrystalline diamonds and the drill bit body at the sintering temperature for a sintering time duration in a range of from about 10 minutes to about 360 minutes. In some implementations, the sintering process includes cooling the polycrystalline diamonds and the drill bit body at a cooling rate in a range of from about −1° C./min to about −40° C./min after maintaining the polycrystalline diamonds and the drill bit body at the sintering temperature for the sintering time duration.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This present disclosure relates to the manufacture of drill bits used for oil and gas wellbore formation. The drill bits disclosed include catalyst-free polycrystalline diamond materials. The polycrystalline diamond materials are formed from nano-sized and micro-sized diamond particles and are formed using an ultra-high pressure and high temperature (UHPHT) technology. The formed polycrystalline diamond materials provide superior abrasive wear, impact damage, and thermal fatigue, thereby overcoming the deficiencies of current polycrystalline diamond materials formed using the high pressure, high-temperature (HPHT) technology. In some instances, the polycrystalline diamond material has a hardness of single-crystal diamond, which is more than twice as hard as the hardness of current polycrystalline diamond compact (PDC) cutters. Additionally, in some instances, the polycrystalline diamond produced using the UHPHT technology has a fracture toughness that approaches that of metallic materials. Further, the catalyst-free PDC cutter described can have superior thermal resistance for temperatures of up to 1400 degrees Celsius (° C.) in the presence of air in comparison to conventional PDC cutters. The enhanced thermal resistance of the catalyst-free PDC cutter described can allow the PDC cutter to be implemented by a pre-loaded method in manufacturing without risk of thermal degradation. As a result, the polycrystalline diamond material of the present disclosure provides increased drill bit performance, improved drill bit life, and improved cutting efficiency.

Figure 1:
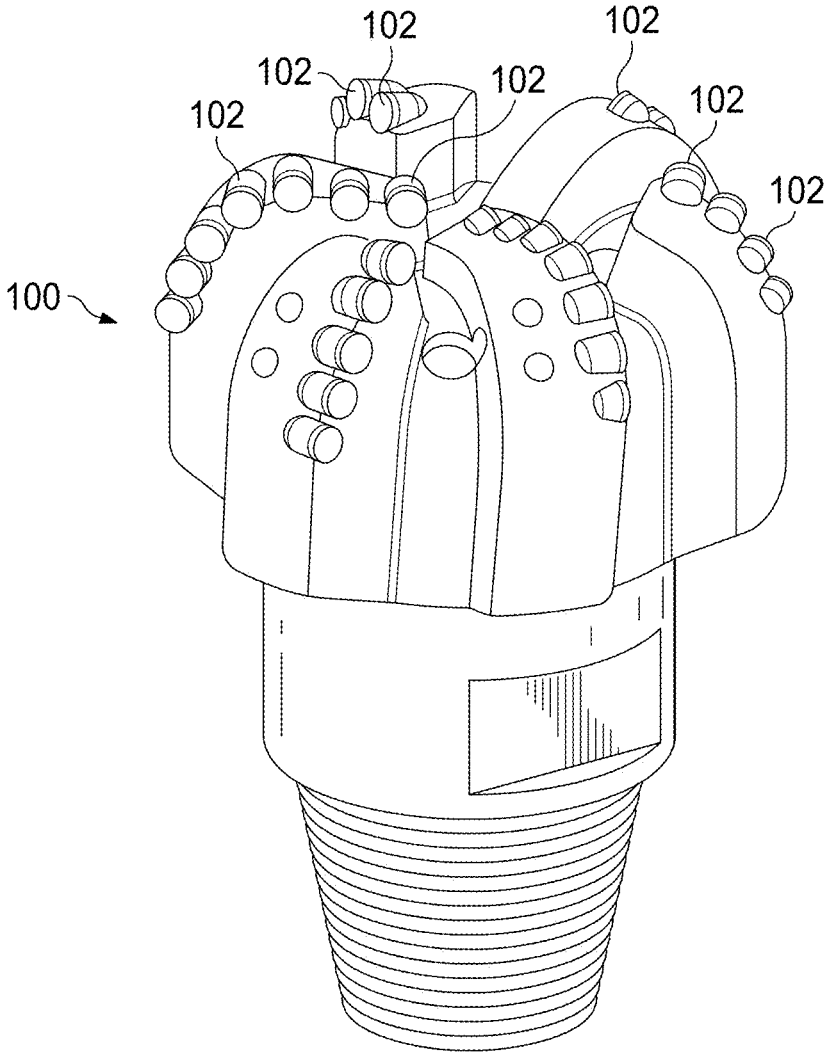
FIG. 1 is a perspective view of an example drill bit used in the oil and gas industry for forming a wellbore.

FIG. 1 is a perspective view of an example drill bit 100 used in the oil and gas industry for forming a wellbore. The drill bit 100 includes a plurality of PDC cutters 102. The PDC cutters 102 operate to cut into rock to form a wellbore. The PDC cutters 102 are synthesized free of a catalyst. That is, the PDC cutters 102 are synthesized without the use of a catalyst, such as catalysts based from cobalt, nickel, a Group VIII metal (for example, iron, ruthenium, osmium, and hassium) or any of their alloys, aluminum, titanium, chromium, manganese, tantalum, nickel aluminide ($Ni_3Al$), or boron-containing nickel aluminide. The PDC cutters 102 are formed from a polycrystalline diamond material formed using UHPHT technology. In some implementations, the UHPHT technology involves forming the polycrystalline diamond material using compressive pressures within a range of 10 gigapascals (GPa) to 35 GPa and temperatures within a range of 2000 Kelvin (K) to 3000 K.

Figure 2A:
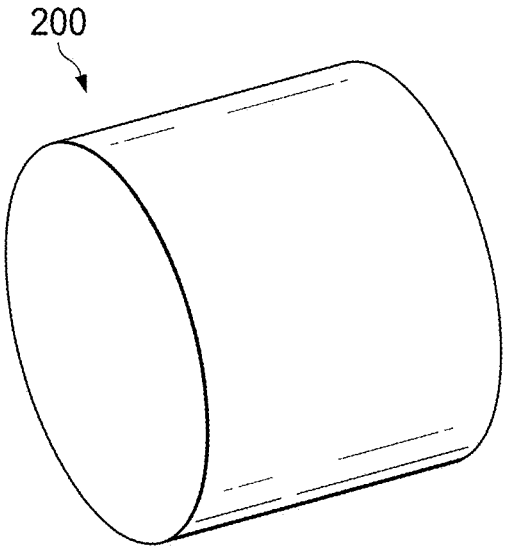
FIG. 2A is a perspective view of an example PDC cutter.
Figure 2B:
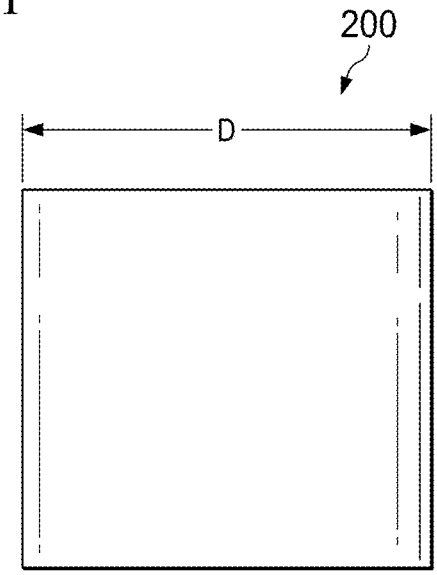
FIG. 2B is a side view of the example PDC cutter of FIG. 2A.

FIG. 2A is a perspective view of an example PDC cutter 200. One or more of the PDC cutters 102 of drill bit 100 shown in FIG. 1 can be implementations of the PDC cutter 200 shown in FIG. 2A. FIG. 2B is a side view of the example PDC cutter of FIG. 2A. In some implementations, the PDC cutter 200 is disc-shaped. The PDC cutter 200 includes a polycrystalline diamond layer and is free of a substrate. As mentioned previously, the PDC cutter 200 is formed without the use of a catalyst. In some implementations, the polycrystalline diamond layer has a thickness within a range of from 2 millimeters (mm) to 4 mm. In some implementations, the polycrystalline diamond layer has a thickness greater than 4 mm or less than 2 mm.

In the illustrated example of FIGS. 2A and 2B, the PDC cutter 200 has a circular cross-sectional shape. A cross-sectional dimension (for example, diameter) D of the PDC cutter 200 may vary according to a desired size of the PDC cutter 200. In some implementations, the PDC cutter 200 has a cross-sectional dimension D within a range of from 4 mm to 48 mm. In some implementations, the cross-sectional dimension D of the PDC cutter 200 is greater than 48 mm or less than 4 mm. As shown in FIG. 2A, the PDC cutter 200 can have a cylindrical shape. In some implementations, the cross-sectional shape of the PDC cutter 200 may be other than circular. In some implementations, the PDC cutter 200 has a non-circular cross-sectional shape. For example, the PDC cutter 200 may be oval, square, rectangular, or have an irregular shape. The cross-sectional dimension of the PDC cutter 200 may be within a range of from 4 mm to 48 mm.

Figure 3A:
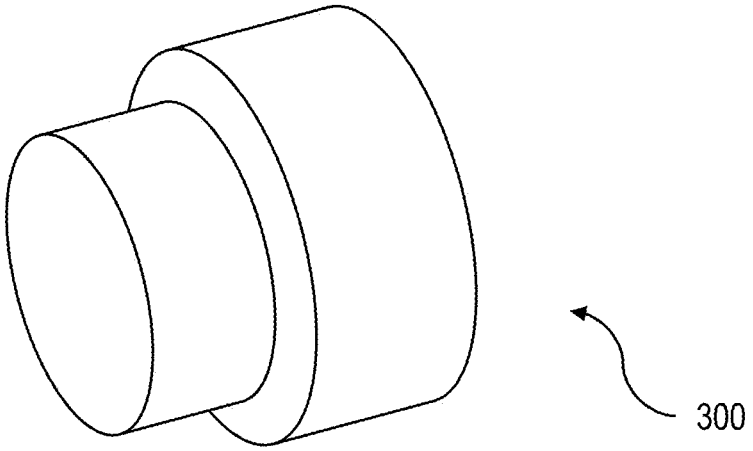
FIG. 3A is a perspective view of an example PDC cutter.
Figure 3B:
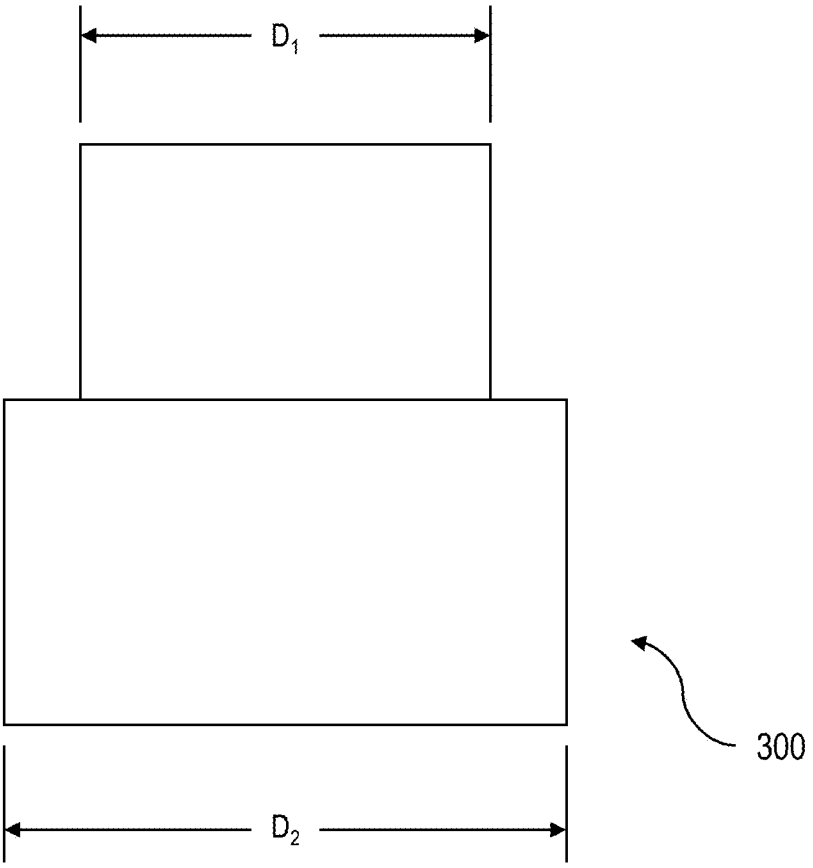
FIG. 3B is a side view of the example PDC cutter of FIG. 3A.

FIG. 3A is a perspective view of an example PDC cutter 300. One or more of the PDC cutters 102 of drill bit 100 shown in FIG. 1 can be implementations of the PDC cutter 300 shown in FIG. 3A. PDC cutter 300 can be substantially similar to PDC cutter 200. For example, PDC cutter 300 is substantially the same as PDC cutter 200 but simply has a different shape and dimensions from PDC cutter 200. FIG. 3B is a side view of the example PDC cutter of FIG. 3A. In some implementations, a first cross-sectional dimension ($D_1$) of the PDC cutter 300 is at least 4 millimeters. In some implementations, a second cross-sectional dimension ($D_2$) is greater than the first cross-sectional dimension, $D_1$. In some implementations, $D_2$ is at least 0.5 mm greater than $D_1$. Similar to PDC cutter 200, the PDC cutter 300 can have a non-circular cross-sectional shape. For example, the PDC cutter 300 can have an oval, a square, a rectangular, or an irregular shape. In such implementations, the non-circular cross-sectional shape can have a step width that is at least 0.25 mm for each and every side.

Figure 4A:
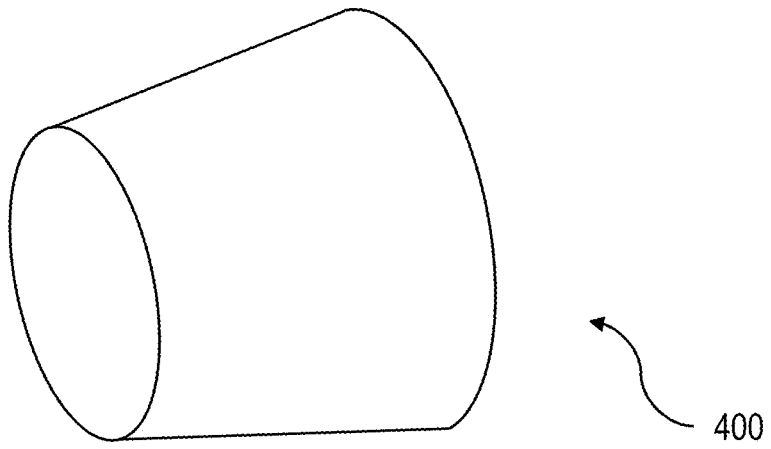
FIG. 4A is a perspective view of an example PDC cutter.
Figure 4B:
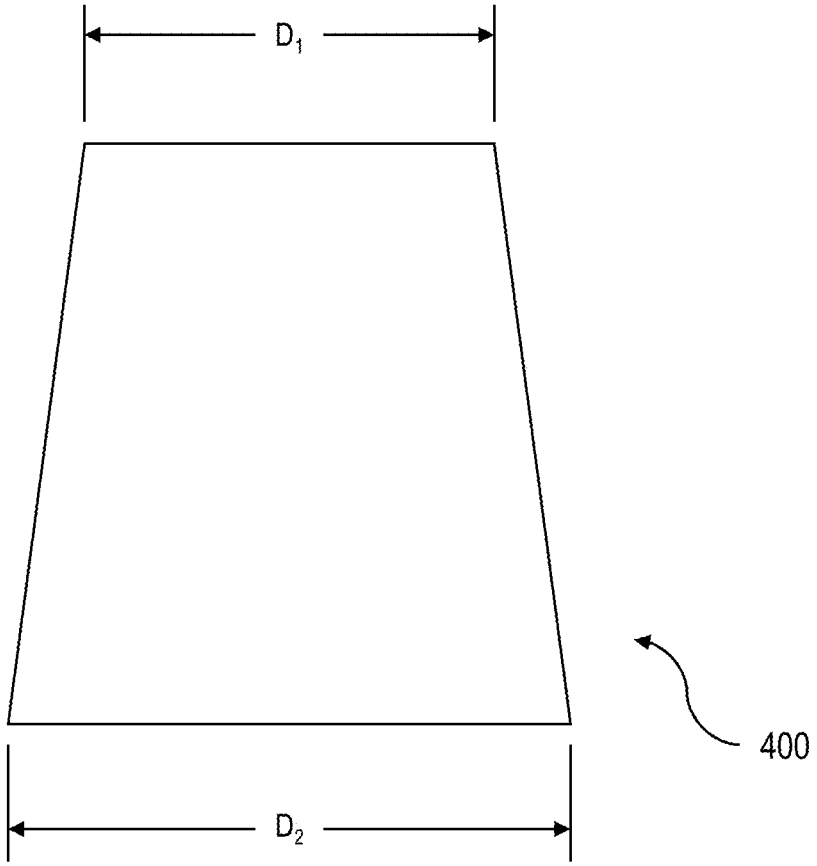
FIG. 4B is a side view of the example PDC cutter of FIG. 4A.

FIG. 4A is a perspective view of an example PDC cutter 400. One or more of the PDC cutters 102 of drill bit 100 shown in FIG. 1 can be implementations of the PDC cutter 400 shown in FIG. 4A. PDC cutter 400 can be substantially similar to PDC cutter 200 and/or PDC cutter 300. For example, PDC cutter 400 is substantially the same as PDC cutter 200 and/or 300 but simply has a different shape and dimensions from PDC cutter 200 and/or 300. FIG. 4B is a side view of the example PDC cutter of FIG. 4A.

Figure 5A:
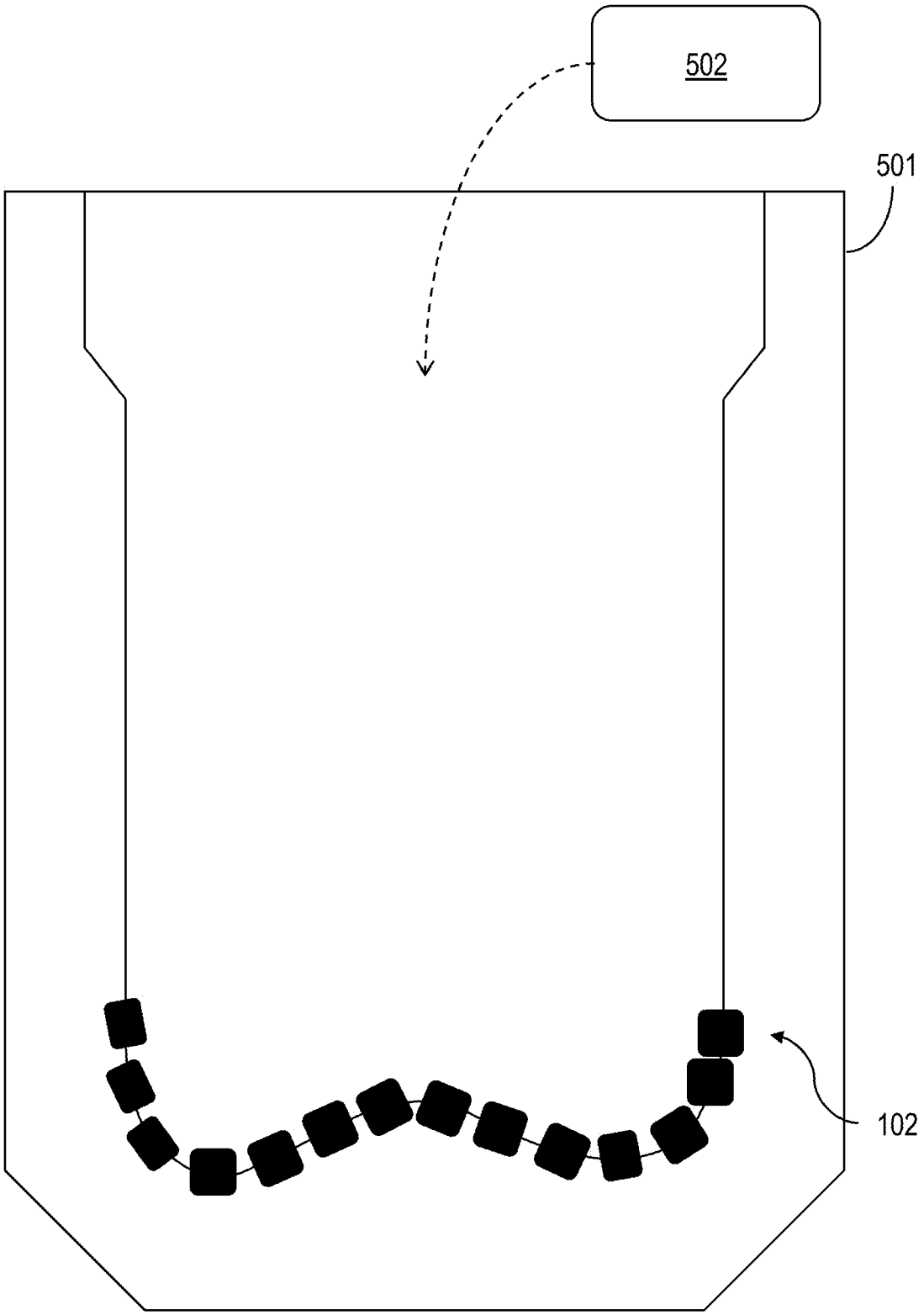
FIG. 5A is a schematic diagram of an example PDC drill bit including an example PDC cutter being formed.

FIG. 5A is a schematic diagram of an example PDC drill bit being formed. In FIG. 5A, the plurality of PDC cutters 102 are already deposited within the mold 501. As mentioned previously, one or more of the PDC cutters 102 can be implementations of the PDC cutter 200, 300, 400, or any combination of these. For example, all of the PDC cutters 102 can be implementations of the PDC cutter 200. For example, all of the PDC cutters 102 can be implementations of the PDC cutter 300. For example, all of the PDC cutters 102 can be implementations of the PDC cutter 400. For example, some of the PDC cutters 102 can be implementations of the PDC cutter 200 while others can be implementations of the PDC cutter 300. For example, some of the PDC cutters 102 can be implementations of the PDC cutter 200 while others can be implementations of the PDC cutter 400. For example, some of the PDC cutters 102 can be implementations of the PDC cutter 300 while others can be implementations of the PDC cutter 400. For example, some of the PDC cutters 102 can be implementations of the PDC cutter 200, some of the PDC cutters 102 can be implementations of the PDC cutter 300, and the remaining PDC cutters 102 can be implementations of the PDC cutter 400.

With the PDC cutters 102 deposited within the mold 501, a matrix body material 502 is deposited within the mold 501. For example, the matrix body material 502 is poured in liquid form into the mold 501. Once the matrix body material 502 and the PDC cutters 102 have been deposited within the mold 501, an infiltration process can be performed to bond the PDC cutters 102 to the matrix body material 502 and form a PDC drill bit, for example, the PDC drill bit 100 shown in FIG. 1. The infiltration process is described in more detail later. The matrix body material 502 can be made of, for example, copper, nickel, cobalt, iron, molybdenum, titanium, or an alloy based on any of these metals individually or any combination of these metals. In some implementations, the matrix body material 502 includes an alloying element, such as manganese, tin, zinc, silicon, tungsten, boron, phosphorus, or any combination of these elements. In implementations in which certain levels of hardness, wear resistance, and erosion resistance are desired, additional "hard" particles can be provided as a reinforcement phase to the matrix body material 502. Such hard particles can include a carbide, such as tungsten carbide, silicon carbide, molybdenum carbide, titanium carbide, niobium carbide, tantalum carbide, chromium carbide, vanadium carbide, or any combination of these carbides. In some implementations, the hard particles include an oxide, a nitride, a silicide, a boride, or any combination of these compounds.

Figure 5B:
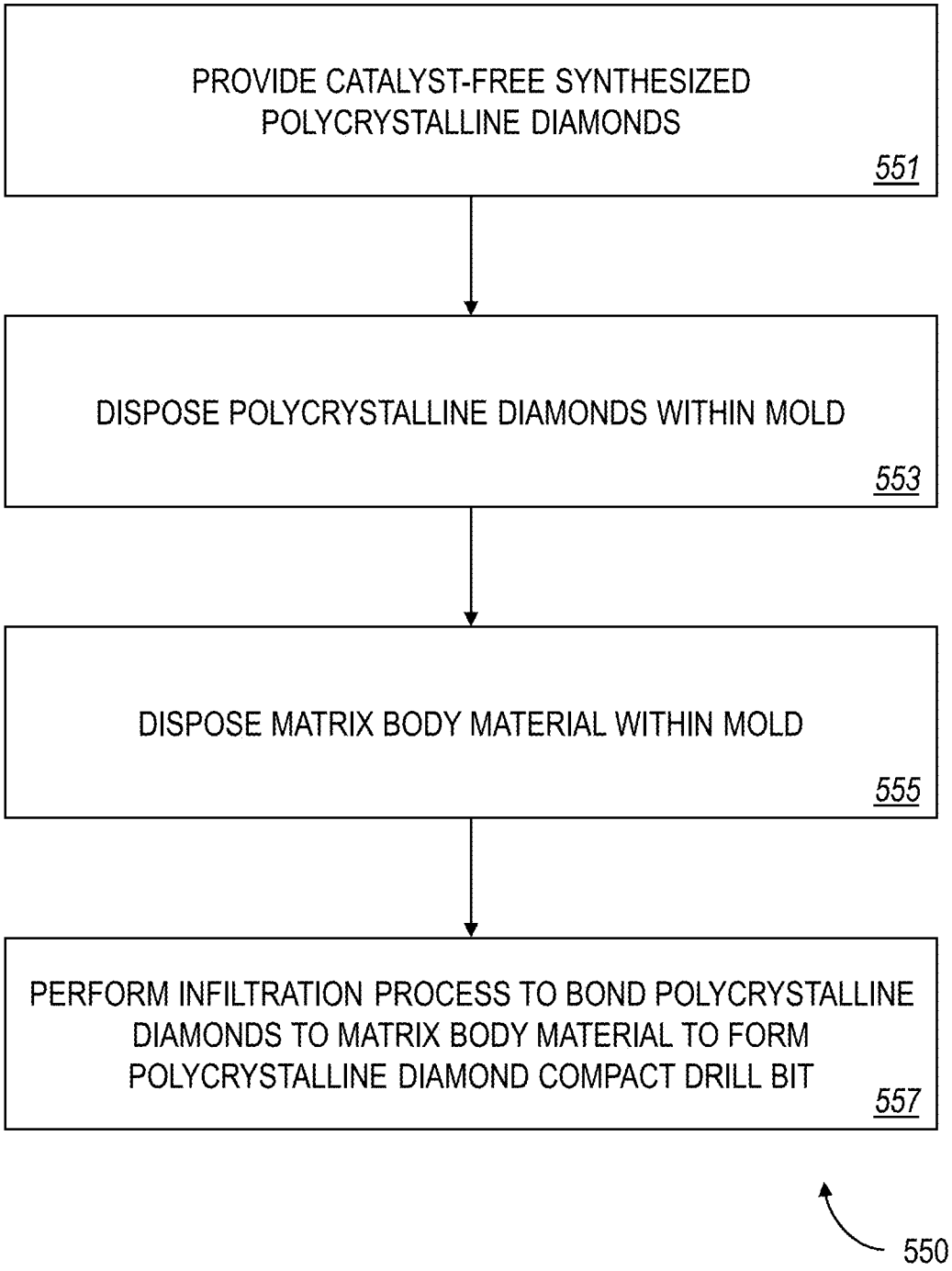
FIG. 5B is a flow chart of an example method for forming a PDC drill bit including a PDC cutter.

FIG. 5B is a flow chart of an example method 550 for forming a PDC drill bit (such as the PDC drill bit 100) including a PDC cutter (such as the PDC cutter 200, 300, or 400). At block 551 a plurality of catalyst-free synthesized polycrystalline diamonds are provided. Each of the polycrystalline diamonds provided at block 551 have a cross-sectional dimension of at least 4 millimeters. For example, a plurality of the PDC cutters 200 are provided at block 551. For example, a plurality of the PDC cutters 300 are provided at block 551. For example, a plurality of the PDC cutters 400 are provided at block 551. For example, a plurality of the PDC cutters 200 and a plurality of the PDC cutters 300 are provided at block 551. For example, a plurality of the PDC cutters 200 and a plurality of the PDC cutters 400 are provided at block 551. For example, a plurality of the PDC cutters 300 and a plurality of the PDC cutters 400 are provided at block 551. For example, a plurality of the PDC cutters 200, a plurality of the PDC cutters 300, and a plurality of PDC cutters 400 are provided at block 551.

In some implementations, providing the plurality of polycrystalline diamonds at block 551 includes synthesizing each of the polycrystalline diamonds from diamond powder with a particle size within a range of from about 0.1 micrometers (μm) to about 50 μm. In some implementations, providing the plurality of polycrystalline diamonds at block 551 includes shaping each of the synthesized polycrystalline diamonds by laser cutting or mechanical grinding. In some implementations, the cross-sectional dimension of at least 4 millimeters for each of the polycrystalline diamonds provided at block 551 is a first cross-sectional dimension, and each of the polycrystalline diamonds has a second cross-sectional dimension greater than the first cross-sectional dimension. Examples of such implementations are shown by PDC cutters 300 (shown in FIGS. 3A and 3B) and 400 (shown in FIGS. 4A and 4B).

At block 553, the plurality of polycrystalline diamonds (provided at block 551) is deposited within a mold (such as the mold 501). After depositing the plurality of polycrystalline diamonds within the mold 501 at block 553, a matrix body material (such as the matrix body material 502) is deposited within the mold 501 at block 555. For example, the matrix body material 502 is poured in liquid form into the mold 501 at block 555.

At block 557, an infiltration process is performed to bond the plurality of polycrystalline diamonds to the matrix body material 502 and form the PDC drill bit 100. The infiltration process at block 557 includes heating the plurality of polycrystalline diamonds and the matrix body material 502 deposited within the mold 501 to an infiltration temperature that is greater than about 700° C. and less than about 1400° C. In some implementations, the infiltration temperature is less than about 800° C. In some implementations, the infiltration temperature is in a range of from about 700° C. to about 800° C. In some implementations, the infiltration temperature is about 700° C. In some implementations, the infiltration temperature is about 750° C. In some implementations, the infiltration temperature is about 800° C.

The infiltration process at block 557 is a controlled diffusion process. In order to achieve complete penetration, the infiltration process at block 557 requires sufficient time to complete. Further, organic material in powder form evaporates during the infiltration process at block 557, and the evaporation requires sufficient time to complete as well. In some implementations, the infiltration process at block 557 includes heating the plurality of polycrystalline diamonds and the matrix body material 502 deposited within the mold 501 at a heating rate in a range of from about 1° C. per minute (° C./min) to about 40° C./min until the plurality of polycrystalline diamonds and the matrix body material 502 deposited within the mold 501 reach the infiltration temperature. In some implementations, the heating rate for the infiltration process at block 557 is in a range of from about 2° C./min to about 20° C./min, from about 3° C./min to about 15° C./min, or from about 5° C./min to about 10° C./min. In some implementations, the infiltration process at block 557 includes maintaining the plurality of polycrystalline diamonds and the matrix body material 502 deposited within the mold 501 at the infiltration temperature for an infiltration time duration in a range of from about 10 minutes to about 180 minutes. In some implementations, the infiltration time duration for the infiltration process at block 557 is in a range of from about 20 minutes to about 120 minutes or from about 30 minutes to about 60 minutes. Heating at quicker heating rates and/or carrying out the infiltration process for time durations that are shorter at block 557 may result in trapping organic vapor in the matrix body material 502 (which starts in liquid form at block 555), which is undesirable, as the trapped organic vapor can cause the formation of void space in the resulting body of the PDC drill bit. Void spaces in the body of the PDC drill bit is undesired because the presence of void spaces in the body of the PDC drill bit means that the body of the PDC drill bit is porous, which can negatively affect the strength, ductility, and/or brittleness of the resulting body of the PDC drill bit.

In some implementations, after maintaining the plurality of polycrystalline diamonds and the matrix body material 502 deposited within the mold 501 at the infiltration temperature for the infiltration time duration, the plurality of polycrystalline diamonds and the matrix body material 502 deposited within the mold 501 are cooled at a cooling rate in a range of from about −1° C./min to about −40° C./min. In some implementations, the cooling rate is in a range of from about −2° C./min to about −20° C./min, from about −3° C./min to about −15° C./min, or from about −5° C./min to about −10° C./min. Cooling at quicker cooling rates may result in deformation (for example, cracking) of the resulting body of the PDC drill bit due to thermally induced stress. In some implementations, after the plurality of polycrystalline diamonds and the matrix body material 502 deposited within the mold 501 have been cooled, the formed PDC drill bit 100 is removed from the mold 501.

Figure 6A:
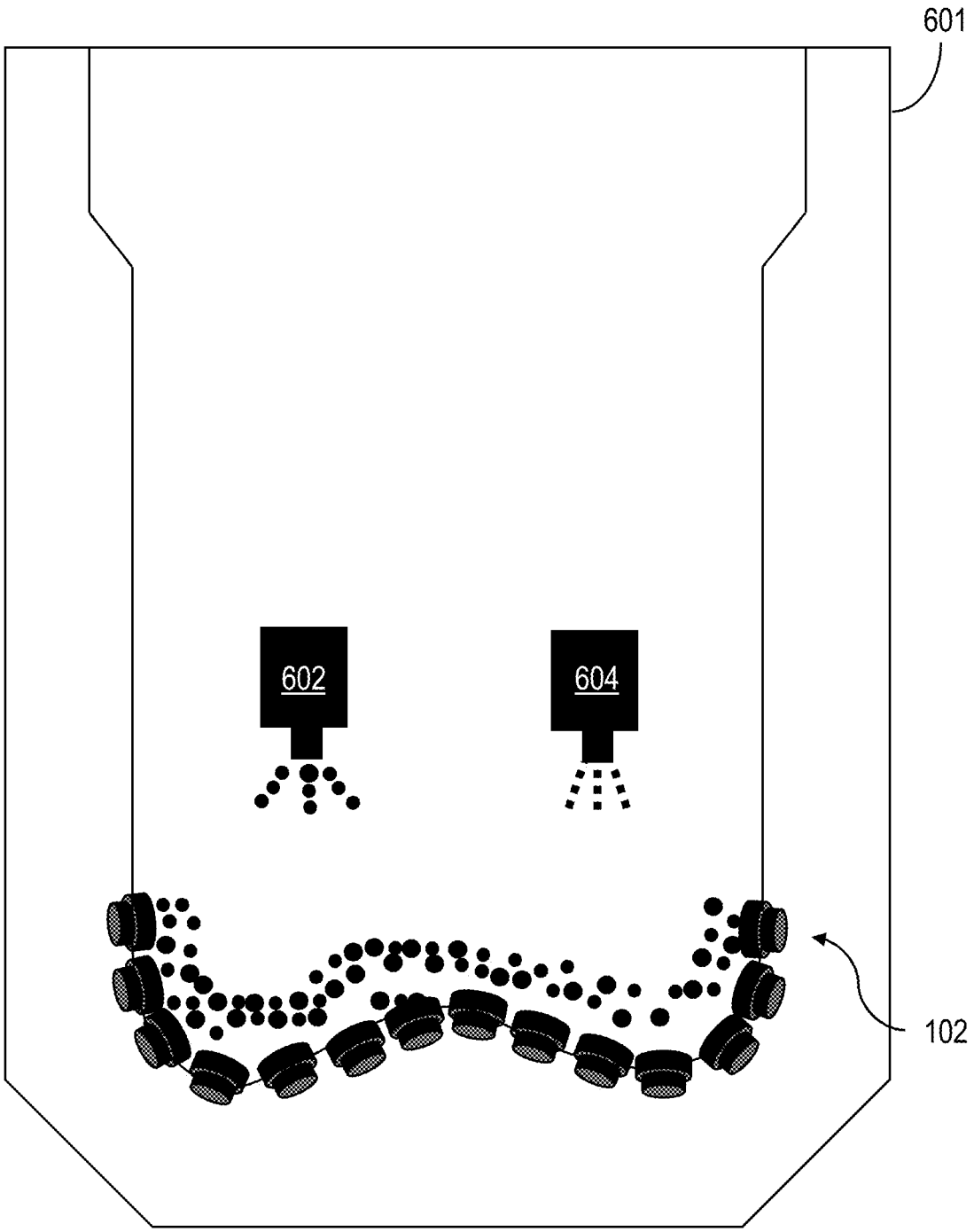
FIG. 6A is a schematic diagram of an example PDC drill bit including an example PDC cutter being formed.

FIG. 6A is a schematic diagram of an example PDC drill bit being formed. In FIG. 6A, the plurality of PDC cutters 102 are already deposited within the mold 601. As mentioned previously, one or more of the PDC cutters 102 can be implementations of the PDC cutter 200, 300, 400, or any combination of these. With the PDC cutters 102 deposited within the mold 601, a drill bit body is formed within the mold 601. Forming the drill bit body within the mold 601 includes depositing a layer of matrix body material particles 602 within the mold 601. For example, the matrix body material particles 602 are sprayed into the mold 601 to form a layer within the mold 601. The matrix body material particles 602 can be substantially similar to the matrix body material 502. The matrix body material particles 602 can be made of, for example, copper, nickel, cobalt, iron, molybdenum, titanium, or an alloy based on any of these metals individually or any combination of these metals. In some implementations, the matrix body material particles 602 include an alloying element, such as manganese, tin, zinc, silicon, tungsten, boron, phosphorus, or any combination of these elements. In implementations in which certain levels of hardness, wear resistance, and erosion resistance are desired, additional "hard" particles can be provided as a reinforcement phase to the matrix body material particles 602. Such hard particles can include a carbide, such as tungsten carbide, silicon carbide, molybdenum carbide, titanium carbide, niobium carbide, tantalum carbide, chromium carbide, vanadium carbide, or any combination of these carbides. In some implementations, the hard particles include an oxide, a nitride, a silicide, a boride, or any combination of these compounds.

Forming the drill bit body within the mold 601 includes depositing an adhesive ink 604 within the mold 601. For example, the adhesive ink 604 is sprayed into the mold 601. The adhesive ink 604 can be, for example, a phenolic resin, a thermosetting polymer, wax, an ultraviolet light-curable photopolymer, an ultraviolet acrylic, a solvent-based polymer (such as polyimide or polyurethane), polyvinylpyrrolidone, a resin based from an amorphous fluoropolymer of tetrafluoroethylene, a silver-based ink, a gold-based ink, a platinum-based ink, a copper-based ink, or an aluminum-based ink. Forming the drill bit body within the mold 601 includes curing the adhesive ink 604 once it has been deposited within the mold 601. Curing the adhesive ink 604 can include, for example, exposing the adhesive ink 604 to ultraviolet light for a time duration in a range of from about 5 minutes to about 30 minutes. Curing the adhesive ink 604 can include, for example, simply allowing the adhesive ink 604 to cure on its own undisturbed for a time duration before proceeding to a subsequent step. Forming the drill bit body within the mold 601 can include repeating the steps of depositing the layer of matrix body material particles 602 within the mold 601, depositing the adhesive ink 604 within the mold 601, and curing the adhesive ink 604 in that order until the drill bit body is formed. Once the drill bit body has been formed, a sintering process can be performed to remove at least a portion of the cured adhesive ink 604 and increase a density of the drill bit body to form a PDC drill bit, for example, the PDC drill bit 100 shown in FIG. 1. The sintering process is described in more detail later.

Figure 6B:
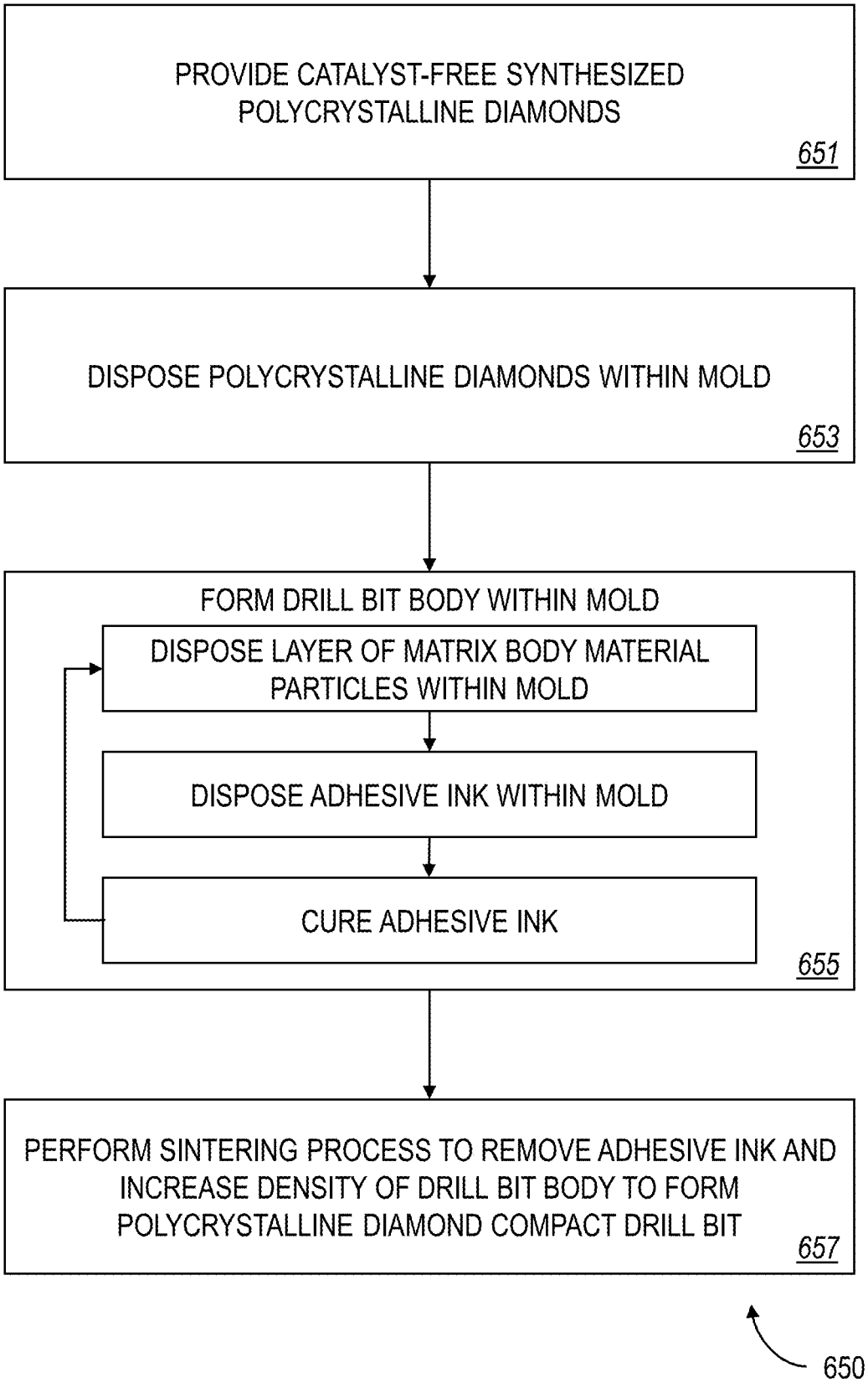
FIG. 6B is a flow chart of an example method for forming a PDC drill bit including a PDC cutter.

FIG. 6B is a flow chart of an example method 650 for forming a PDC drill bit (such as the PDC drill bit 100) including a PDC cutter (such as the PDC cutter 200, 300, or 400). At block 651 a plurality of catalyst-free synthesized polycrystalline diamonds are provided. Each of the polycrystalline diamonds provided at block 651 have a cross-sectional dimension of at least 4 millimeters. For example, a plurality of the PDC cutters 200 are provided at block 651. For example, a plurality of the PDC cutters 300 are provided at block 651. For example, a plurality of the PDC cutters 400 are provided at block 651. For example, a plurality of the PDC cutters 200 and a plurality of the PDC cutters 300 are provided at block 651. For example, a plurality of the PDC cutters 200 and a plurality of the PDC cutters 400 are provided at block 651. For example, a plurality of the PDC cutters 300 and a plurality of the PDC cutters 400 are provided at block 651. For example, a plurality of the PDC cutters 200, a plurality of the PDC cutters 300, and a plurality of PDC cutters 400 are provided at block 651.

In some implementations, providing the plurality of polycrystalline diamonds at block 651 includes synthesizing each of the polycrystalline diamonds from diamond powder with a particle size within a range of from about 0.1 micrometers (μm) to about 50 μm. In some implementations, providing the plurality of polycrystalline diamonds at block 651 includes shaping each of the synthesized polycrystalline diamonds by laser cutting or mechanical grinding. In some implementations, the cross-sectional dimension of at least 4 millimeters for each of the polycrystalline diamonds provided at block 651 is a first cross-sectional dimension, and each of the polycrystalline diamonds has a second cross-sectional dimension greater than the first cross-sectional dimension. Examples of such implementations are shown by PDC cutters 300 (shown in FIGS. 3A and 3B) and 400 (shown in FIGS. 4A and 4B).

At block 653, the plurality of polycrystalline diamonds (provided at block 651) is deposited within a mold (such as the mold 601). After depositing the plurality of polycrystalline diamonds within the mold 601 at block 653, a drill bit body is formed within the mold 601 at block 655. Forming the drill bit body within the mold 601 at block 655 includes depositing a layer of matrix body material particles 602 within the mold 601. For example, the matrix body material particles 602 are sprayed into the mold 601 to form a layer within the mold 601 at block 655. Forming the drill bit body within the mold 601 at block 655 includes depositing an adhesive ink 604 within the mold 601. For example, the adhesive ink 604 is sprayed into the mold 601 at block 655. Forming the drill bit body within the mold 601 at block 655 includes curing the adhesive ink 604 once it has been deposited within the mold 601. Curing the adhesive ink 604 at block 655 can include, for example, exposing the adhesive ink 604 to ultraviolet light for a time duration. Curing the adhesive ink 604 at block 655 can include, for example, simply allowing the adhesive ink 604 to cure on its own undisturbed for a time duration before proceeding to a subsequent step. Forming the drill bit body within the mold 601 at block 655 can include repeating the steps of depositing the layer of matrix body material particles 602 within the mold 601, depositing the adhesive ink 604 within the mold 601, and curing the adhesive ink 604 in that order until the drill bit body is formed.

After the drill bit body has been formed at block 655, a sintering process is performed at block 657 to remove at least a portion of the cured adhesive ink 604 and increase a density of the drill bit body to form the PDC drill bit 100. The sintering process at block 657 includes heating the plurality of polycrystalline diamonds and the drill bit body to a sintering temperature greater than about 600° C. and less than about 1400° C. In some implementations, the sintering temperature is less than about 1000° C. In some implementations, the sintering temperature is in a range of from about 650° C. to about 1000° C. or from about 700° C. to about 850° C. In some implementations, the sintering temperature is about 750° C.

In some implementations, the sintering process at block 657 includes heating the plurality of polycrystalline diamonds and the drill bit body at a heating rate in a range of from about 1° C./min to about 40° C./min until the plurality of polycrystalline diamonds and the drill bit body reach the sintering temperature. In some implementations, the heating rate for the sintering process at block 657 is in a range of from about 2° C./min to about 20° C./min, from about 3° C./min to about 15° C./min, or from about 5° C./min to about 10° C./min. In some implementations, the sintering process at block 657 includes maintaining the plurality of polycrystalline diamonds and the drill bit body at the sintering temperature for a sintering time duration in a range of from about 10 minutes to about 360 minutes. In some implementations, the sintering time duration for the sintering process at block 657 is in a range of from about 20 minutes to about 180 minutes, from about 30 minutes to about 120 minutes, or from about 60 minutes to about 90 minutes. Heating at quicker heating rates and/or carrying out the sintering process for time durations that are shorter at block 657 may result in trapping organic vapor in the resulting body of the PDC drill bit, which is undesirable, as the trapped organic vapor can cause the formation of void space in the resulting body of the PDC drill bit. Void spaces in the body of the PDC drill bit is undesired because the presence of void spaces in the body of the PDC drill bit means that the body of the PDC drill bit is porous, which can negatively affect the strength, ductility, and/or brittleness of the resulting body of the PDC drill bit. Heating at quicker heating rates and/or carrying out the sintering process for time durations that are shorter at block 657 may result in incomplete bonding of the matrix body material particles 602 to each other and/or to the hard particles, which is undesirable because incomplete bonding can negatively affect the strength, ductility, and/or brittleness of the resulting body of the PDC drill bit.

In some implementations, after maintaining the plurality of polycrystalline diamonds and the drill bit body at the sintering temperature for the sintering time duration, the plurality of polycrystalline diamonds and the drill bit body are cooled at a cooling rate in a range of from about −1° C./min) to about −40° C./min. In some implementations, the cooling rate is in a range of from about −2° C./min to about −20° C./min, from about −3° C./min to about −15° C./min, or from about −5° C./min to about −10° C./min. Cooling at quicker cooling rates may result in deformation (for example, cracking) of the resulting body of the PDC drill bit due to thermally induced stress.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

forming a plurality of catalyst-free, substrate-free synthesized polycrystalline diamonds using compressive pressures within a range of 10 Gigapascals (GPa) to 35 GPa and temperatures within a range of 2000 Kelvin (K) to 3000 K, wherein each polycrystalline diamond is free of a substrate;

providing the plurality of polycrystalline diamonds, each of the polycrystalline diamonds having a cross-sectional dimension of at least 4 millimeters;

depositing the plurality of polycrystalline diamonds within a mold;

after depositing the plurality of polycrystalline diamonds within the mold, depositing a matrix body material within the mold; and performing an infiltration process to bond the plurality of polycrystalline diamonds to the matrix body material and form a substrate-free polycrystalline diamond compact (PDC) drill bit, wherein the infiltration process comprises heating the plurality of polycrystalline diamonds and the matrix body material deposited within the mold to an infiltration temperature greater than about 700 degrees Celsius (° C.) and less than about 1400° C.

2. The method of claim 1, wherein providing the plurality of polycrystalline diamonds comprises synthesizing each of the polycrystalline diamonds from diamond powder with a particle size within a range of from about 0.1 micrometers (μm) to about 50 μm.

3. The method of claim 2, wherein providing the plurality of polycrystalline diamonds comprises shaping each of the synthesized polycrystalline diamonds by laser cutting or mechanical grinding.

4. The method of claim 2, wherein, for each of the polycrystalline diamonds, the cross-sectional dimension of at least 4 millimeters is a first cross-sectional dimension, and each of the polycrystalline diamonds has a second cross-sectional dimension greater than the first cross-sectional dimension.

5. The method of claim 2, wherein the infiltration temperature is less than about 800° C.

6. The method of claim 2, wherein the infiltration temperature is about 800° C.

7. The method of claim 2, wherein the infiltration process comprises heating the plurality of polycrystalline diamonds and the matrix body material deposited within the mold at a heating rate in a range of from about 1° C. per minute (C/min) to about 40° C./min until the plurality of polycrystalline diamonds and the matrix body material deposited within the mold reach the infiltration temperature.

8. The method of claim 7, wherein the infiltration process comprises maintaining the plurality of polycrystalline diamonds and the matrix body material deposited within the mold at the infiltration temperature for an infiltration time duration in a range of from about 10 minutes to about 180 minutes.

9. The method of claim 8, wherein the infiltration process comprises:

after maintaining the plurality of polycrystalline diamonds and the matrix body material deposited within the mold at the infiltration temperature for the infiltration time duration, cooling the plurality of polycrystalline diamonds and the matrix body material deposited within the mold at a cooling rate in a range of from about −1° C. per minute (° C./min) to about −40° C./min; and removing the formed PDC drill bit from the mold.

* * * * *